US010304598B1

(12) United States Patent
Pusthay et al.

(10) Patent No.: US 10,304,598 B1
(45) Date of Patent: May 28, 2019

(54) SURGE ARRESTERS AND RELATED ASSEMBLIES AND METHODS

(71) Applicant: TE Connectivity Corporation, Berwyn, PA (US)

(72) Inventors: Kiran Kumar Pusthay, Cary, NC (US); Senthil A. Kumar, Morrisville, NC (US); Eduardo Fava Gastaldi, Apex, NC (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/875,321

(22) Filed: Jan. 19, 2018

(51) Int. Cl.
*H01C 7/12* (2006.01)
*H01C 17/00* (2006.01)
*H01C 1/012* (2006.01)

(52) U.S. Cl.
CPC ..... *H01C 7/12* (2013.01); *H01C 1/012* (2013.01); *H01C 17/00* (2013.01)

(58) Field of Classification Search
CPC ..... H01C 7/12; H01C 1/012; H01C 17/00
USPC ..... 338/21
See application file for complete search history.

(56) References Cited

U.S. PATENT DOCUMENTS

| | | | | |
|---|---|---|---|---|
| 4,989,115 | A * | 1/1991 | Bourdages | H01C 7/12 338/21 |
| 5,497,138 | A * | 3/1996 | Malpiece | H01C 7/12 338/21 |
| 5,680,289 | A | 10/1997 | Robinson et al. | |
| 6,777,614 | B1 * | 8/2004 | Suenwoldt | H01C 7/12 174/50 |
| 7,522,399 | B2 * | 4/2009 | Siljeholm | H01C 7/12 361/117 |
| 8,009,402 | B2 * | 8/2011 | Klaube | H01C 7/123 361/117 |
| 8,305,184 | B2 * | 11/2012 | Klaube | H01C 7/12 338/21 |
| 8,375,552 | B2 | 2/2013 | Normoyle et al. | |
| 8,629,751 | B2 | 1/2014 | Maher et al. | |
| 8,982,526 | B2 * | 3/2015 | Anjiki | H01C 7/12 361/126 |

* cited by examiner

*Primary Examiner* — Kyung S Lee
(74) *Attorney, Agent, or Firm* — Myers Bigel, P.A.

(57) ABSTRACT

A surge arrester includes an internal core assembly including a stack of a plurality of varistor elements, a first end core support assembly at a first end surface of the stack, a second end core support assembly at a second end surface of the stack, a plurality of rods disposed around a side surface of the stack, a first crimp fitting at a first end of each of the plurality of rods, and a retention feature on each of the first crimp fittings with each retention feature engaging the first end core support assembly to apply compression to the stack.

19 Claims, 10 Drawing Sheets

SURGE ARRESTERS AND RELATED ASSEMBLIES AND METHODS

BACKGROUND

Surge arresters are used to protect equipment connected to power distribution networks from damage by excessive voltage situations caused by lightning strikes, switching surges, incorrect connections, and other abnormal conditions or malfunctions.

The active element in a surge arrester is often a varistor, also referred to as a non-linear varistor because it exhibits a non-linear current-voltage relationship. If the applied voltage is less than a certain voltage (the switching or clamping voltage), the varistor is essentially an insulator and only a small leakage current flows through it. If the applied voltage is greater than the switching voltage, the varistor's resistance drops, allowing an increased current to flow through it. That is, a varistor is highly resistive below its switching voltage and substantially conductive above it.

The surge arrester is commonly attached to an electrical power system in parallel configuration, with one terminal of the device connected to a phase conductor of the electrical power system and the other terminal to ground or neutral. At normal system voltages, the surge arrester is resistant to current flow (except for the leakage current). However, if an overvoltage condition exceeding the switching voltage develops, the surge arrester becomes conductive and shunts the surge energy to ground while "clamping" or limiting the system voltage to a value which can be tolerated without damage to the equipment being protected.

SUMMARY

Some embodiments of the present invention are directed to a surge arrester. The surge arrester includes an internal core assembly including a plurality of varistor elements electrically connected in series and forming a stack of the plurality of varistor elements. The stack has a first end surface, a second end surface, and a side surface extending between the first end surface and the second end surface. The internal core assembly includes a first end core support assembly at the first end surface of the stack, with the first end core fitting assembly including an inner surface that faces the stack and an opposite outer surface. The first end core support assembly includes a plurality of circumferentially spaced apart passageways that extend from the inner surface to the outer surface. The internal core assembly includes a second end core support assembly at the second end surface of the stack, with the second end core fitting assembly including an inner surface that faces the stack and an opposite outer surface. The second end core support assembly includes a plurality of circumferentially spaced apart passageways that extend from the inner surface to the outer surface. The internal core assembly includes a plurality of rods disposed around the side surface of the stack, with each rod including a first end that is received in a corresponding one of the plurality of passageways of the first end core support assembly and a second end that is received in a corresponding one of the plurality of passageways of the second end core support assembly (additionally or alternatively, each rod second end may be coupled to the second end core support assembly). The internal core assembly includes a first crimp fitting at the first end of each of the plurality of rods, with each first crimp fitting including a body comprising an outer wall defining a bore with the first end of the rod received in the bore and with the outer wall crimped to secure the first crimp fitting on the first end of the rod. The internal core assembly includes a retention feature on each of the first crimp fittings with each retention feature engaging the first end core support assembly to apply compression to the stack.

In some embodiments, each first crimp fitting includes a threaded portion extending away from the body of the first crimp fitting and protruding from the outer surface of the first end core support assembly. The retention feature on each of the first crimp fittings may include a nut that is configured to be threadingly received on the threaded portion of the first crimp fitting. The retention feature on each of the first crimp fittings may include a washer between the first end core support assembly and the nut.

In some embodiments, the first end core support assembly comprises first and second core fittings and a core support between the first and second core fittings. The first and second core fittings may each include a body comprising a first side and a second opposite side. The first side of the body of each of the first and second core fittings may include a raised portion at a central portion thereof. The core support may include a body with a central opening defined therein. The first side of the first core fitting may face the first side of the second core fitting and the raised portions of each of the first and second core fittings may be received in the central opening of the core support. The first and second core fittings may be metal and the core support may be plastic.

In some embodiments, the stack defines a longitudinal axis. The plurality of passageways of the first end core support assembly may be parallel to the longitudinal axis.

In some embodiments, a second crimp fitting may be at the second end of each of the rods, with each of the second crimp fittings including a body comprising an outer wall defining a bore with the second end of the rod received in the bore and with the outer wall crimped to secure the second crimp fitting on the second end of the rod. Each second crimp fitting may include a threaded portion extending away from the body of the second crimp fitting and protruding from the outer surface of the second end core support assembly. A retention feature may be on each of the second crimp fittings and may include a nut that is configured to be threadingly received on the threaded portion of the second crimp fitting.

In some embodiments, the internal core assembly includes one or more intermediate core support assemblies positioned between the first and second end core support assemblies. Each intermediate core support assembly may include a plurality of circumferentially spaced apart passageways with one of the plurality of rods received in a corresponding one of the passageways. Each intermediate core support assembly may include first and second core fittings and a core support between the first and second end core fittings. Each intermediate core support assembly may be positioned between adjacent ones of the plurality of varistor elements in the stack with the first core fitting engaging one of the adjacent varistor elements and the second core fitting engaging the other one of the adjacent varistor elements.

In some embodiments, the internal core assembly includes a plurality of interceptor plates between the first and second end core support assemblies. Each interceptor plate may include a plurality of circumferentially spaced apart apertures, and each rod may be received in a corresponding one of the plurality of apertures of the interceptor plate. Each interceptor plate may include a body comprising first and second opposite sides. The body may include a central body portion and a plurality of tabs extending outwardly from the central body portion and with one of the plurality of apertures defined in each tab. Each interceptor plate may be positioned between adjacent ones of the plurality of varistor elements in the stack with the first side of the interceptor plate body engaging one of the adjacent varistor elements and the second side of the interceptor plate body engaging the other one of the adjacent varistor elements. Each interceptor plate may be metal.

In some embodiments, each of the rods is spaced apart from the stack.

In some embodiments, the surge arrester includes an elongated housing. The internal core assembly may be positioned in the housing. The internal core assembly may be spaced apart from an inner surface of the housing.

Some other embodiments of the present invention are directed to an internal core assembly for a surge arrester. The internal core assembly includes a stack of metal-oxide varistor elements, with the stack including a first end surface, a second end surface, and a side surface. The internal core assembly includes first, second, and third elongate rods disposed around the outer surface of the stack, with each of the first second, and third rods including a first end and an opposite second end. The internal core assembly includes a first crimp fitting secured on the first end of each rod, with each first crimp fitting comprising a body crimped on the first end of the rod and a threaded shaft extending from the body. The internal core assembly includes a second crimp fitting secured on the second end of each rod, with each second crimp fitting comprising a body crimped on the second end of the rod and a threaded shaft extending from the body. The internal core assembly includes a first end core support assembly at the first end surface of the stack. The first end core support assembly includes an inner surface that faces the stack and an opposite outer surface. The first end core support assembly includes first, second, and third circumferentially spaced apart passageways receiving the first ends of the first, second, and third rods, respectively. The threaded shaft of each first crimp fitting protrudes from the outer surface of the first end core support assembly. The internal core assembly includes a second end core support assembly at the second end surface of the stack. The second end core support assembly includes an inner surface that faces the stack and an opposite outer surface. The second end core support assembly includes first, second, and third circumferentially spaced apart passageways receiving the second ends of the first, second, and third rods, respectively. The threaded shaft of each second crimp fitting protrudes from the outer surface of the second end core support assembly. The internal core assembly includes a plurality of first retention features, each threadingly engaged with the threaded shaft of one of the first crimp fittings and engaging the outer surface of the first end core support assembly. The internal core assembly includes a plurality of second retention features, each threadingly engaged with the threaded shaft of one of the second crimp fittings and engaging the outer surface of the second end core support assembly.

Some other embodiments of the present invention are directed to a method for assembling a surge arrester. The method includes: crimping a first crimp fitting on a first end of each of first, second, and third elongated rods, with each crimp fitting including a body that is crimped on the first end of the rod and a threaded shaft that extends away from the body; forming at least a portion of a cage by coupling a second, opposite end of each of the first, second, and third rods to a second end core support assembly; receiving a stack of a plurality of varistor elements between the first, second, and third rods such that a first end surface of the stack is at the second end core support assembly; receiving the first ends of the first, second, and third rods in first, second, and, third passageways, respectively, of a first end core support assembly such that an inner surface of the first end core support assembly faces the stack and the threaded shaft of each first crimp fitting protrudes from an opposite outer surface of the first end core support assembly; and installing a retention feature on the threaded shaft of each of the first crimp fittings such that the retention feature engages the first end core support assembly, wherein each retention feature includes a nut that threadingly engages the threaded shaft of the first crimp fitting.

In some embodiments, the method includes crimping a second crimp fitting on the second end of each of the first, second, and third elongated rods, with each second crimp fitting including a body that is crimped on the second end of the rod and a threaded shaft that extends away from the body. In some embodiments, forming at least a portion of a cage by coupling a second, opposite end of each of the first, second, and third rods to a second end core support assembly includes: receiving the second ends of the first, second, and third rods in first, second, and, third passageways, respectively, of the second end core support assembly such that an inner surface of the second end core support assembly faces the stack and the threaded shaft of each second crimp fitting protrudes from an opposite outer surface of the second end core support assembly; and installing a retention feature on the threaded shaft of each of the second crimp fittings such that the retention feature engages the second end core support assembly, wherein each retention feature includes a nut that threadingly engages the threaded shaft of the second crimp fitting.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1:
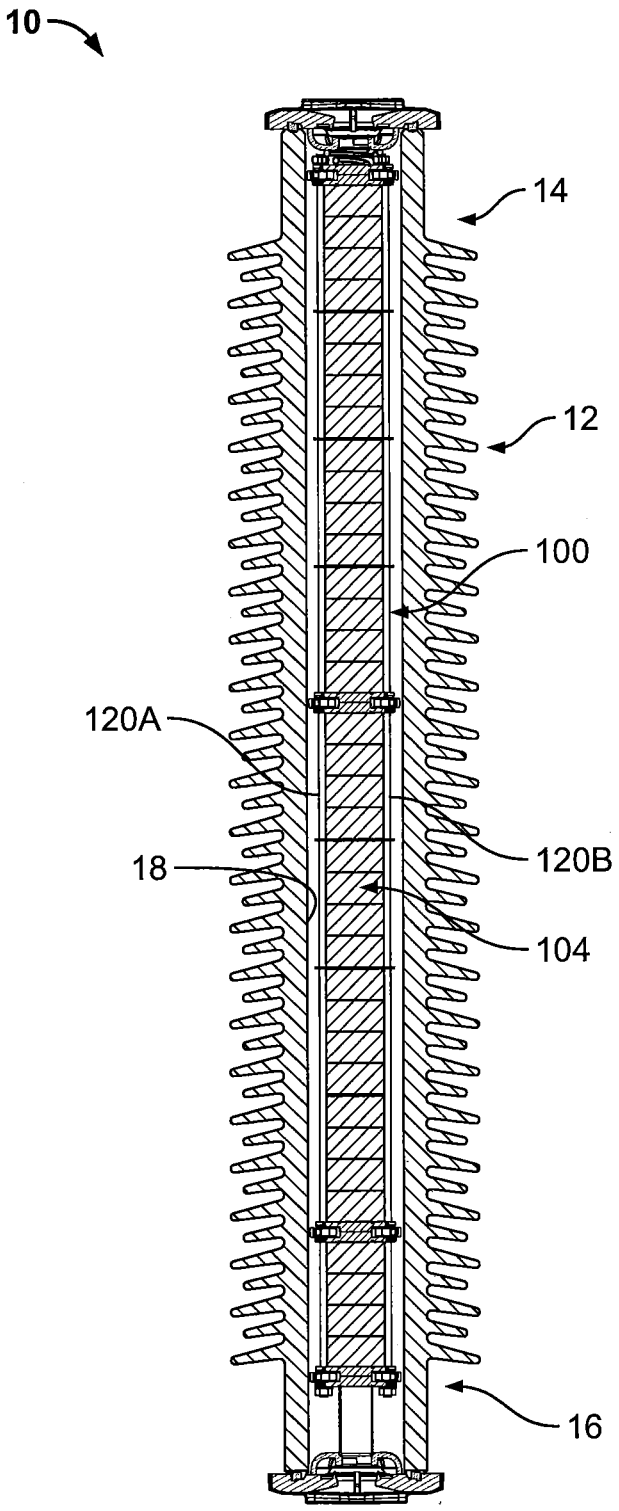
FIG. 1 is a sectional view of a surge arrester according to some embodiments.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A surge arrester 10 according to some embodiments is illustrated in FIG. 1. The surge arrester 10 includes an internal core assembly 100.

Figure 2:
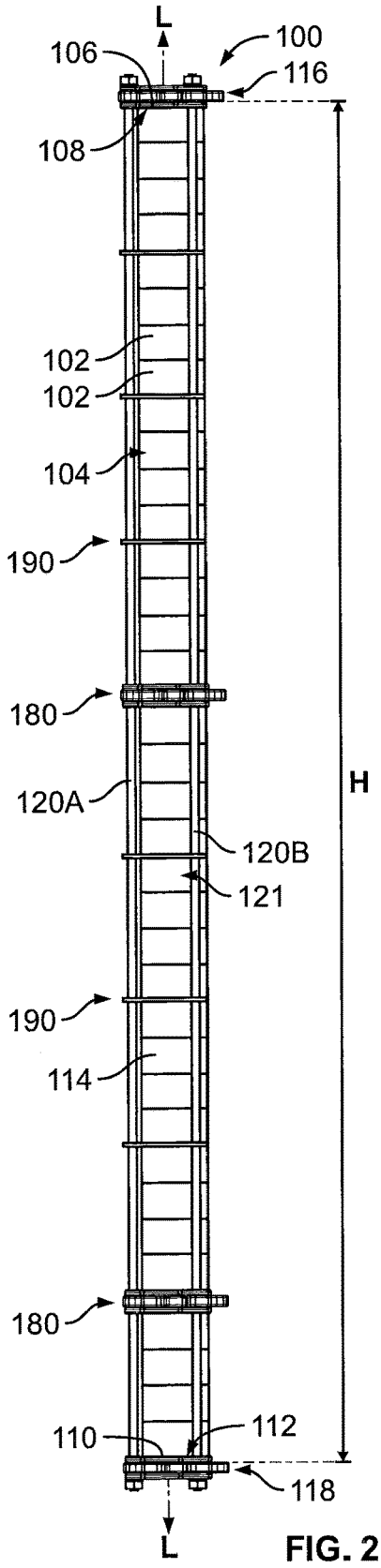
FIG. 2 is a side view of an internal core assembly of the surge arrester of FIG. 1 according to some embodiments.

Referring to FIG. 2, the internal core assembly 100 includes a plurality of varistor elements or blocks 102 that are arranged in a stack 104. The stack 104 defines a longitudinal axis L. In some embodiments, each varistor element 102 is a metal-oxide varistor (MOV). In some embodiments, each varistor element 102 is disk shaped such that the stack 104 is cylindrical. The stack 104 may have a height or length H.

The stack 104 includes a first or upper end surface 106 at a first or upper end portion 108 of the stack 104 and an opposite second or lower end surface 110 at a second or lower end portion 112 of the stack 104. The stack 104 includes a side surface 114 that extends between the first and second end surfaces 106, 110.

The assembly 100 includes a first end core fitting assembly or first end core support assembly 116 at the first end surface 106 of the stack 104 and a second end core fitting assembly or second end core support assembly 118 at the second end surface 110 of the stack 104. The first end core support assembly 116 includes an inner face, side, or surface **116*i* that faces the stack 104 and an opposite outer face, side, or surface 116*o*. The second end core support assembly 118 includes an inner face, side, or surface 118*i* that faces the stack and an opposite outer face, side, or surface 1180**.

Figure 3:
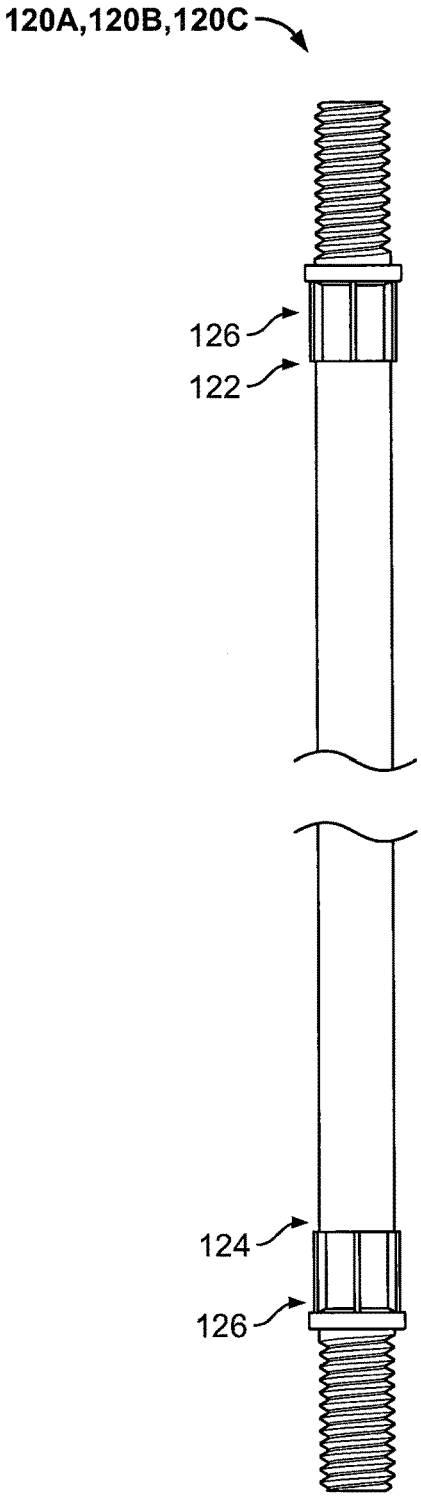
FIG. 3 is a side view of a rod having crimp fittings installed thereon and used in the internal core assembly of FIG. 2 according to some embodiments.
Figure 5:
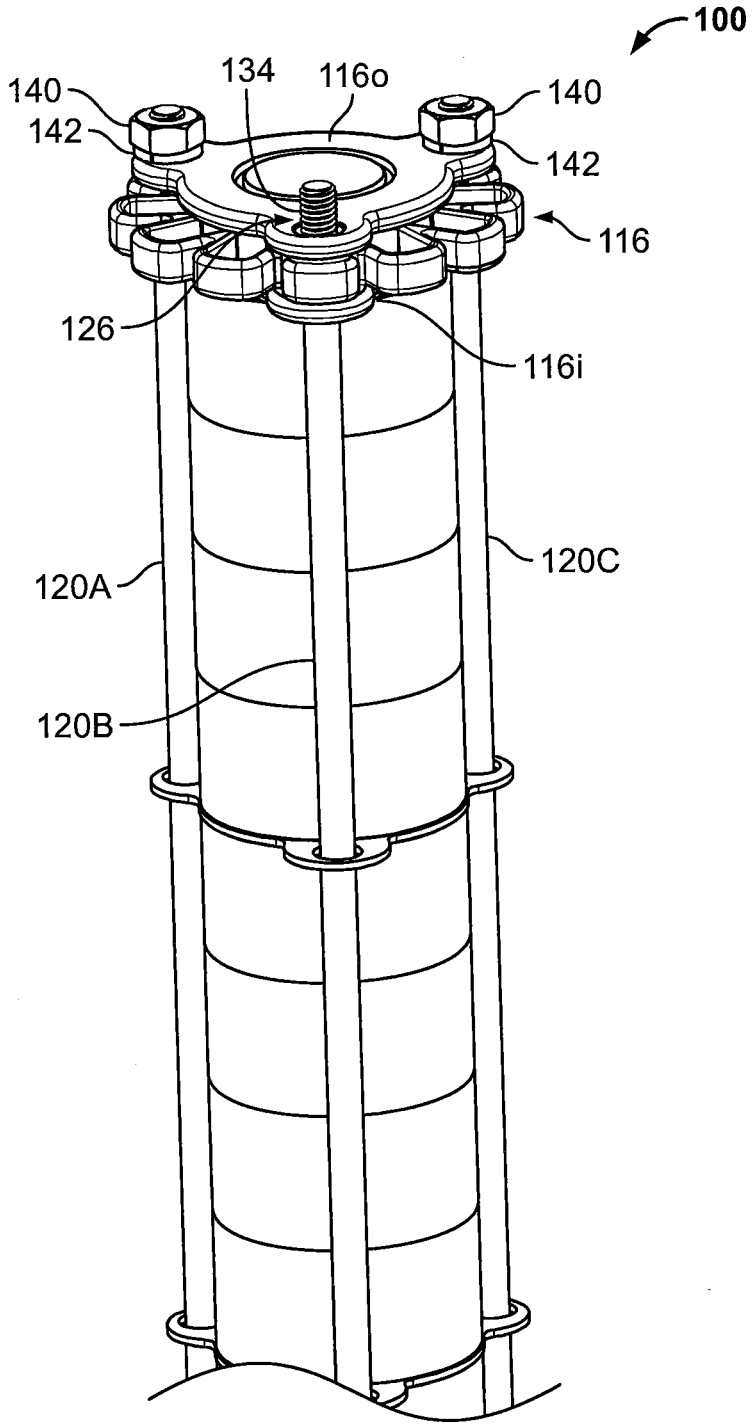
FIG. 5 is a fragmentary perspective view of the internal core assembly of FIG. 2.

Referring to FIGS. 2, 3, and 5, the assembly 100 includes a plurality of rods 120A, 120B, 120C that each extend between the first end core fitting assembly 116 and the second end core fitting assembly 118. Although three rods are illustrated, there may be two rods or more than three rods in various embodiments. In some embodiments, the rods 120A, 120B, 120C are fiberglass reinforced polymer (FRP) rods. The rods 120A, 120B, 120C and/or one or both of the end core support assemblies 116, 118 may define a cage 121.

Referring to FIG. 3, the rods 120A, 120B, 120C each include first and second opposite ends or end portions 122, 124. A crimp fitting 126 may be installed on each of the first and second end portions 122, 124.

Figure 4A:
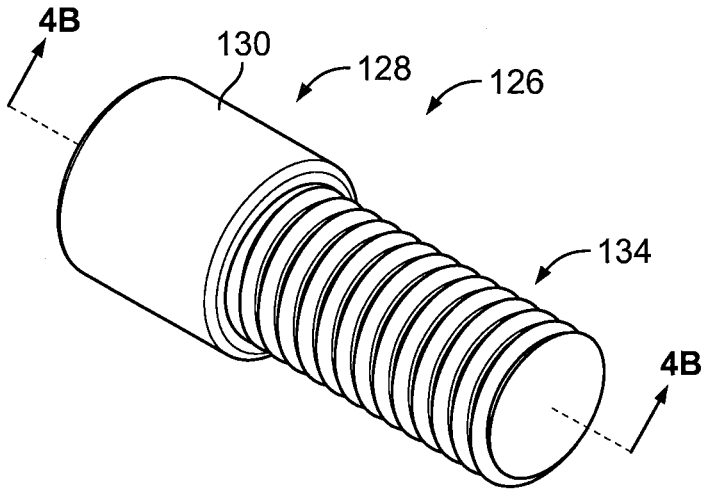
FIG. 4A is a perspective view of one of the crimp fittings of FIG. 3.
Figure 4B:
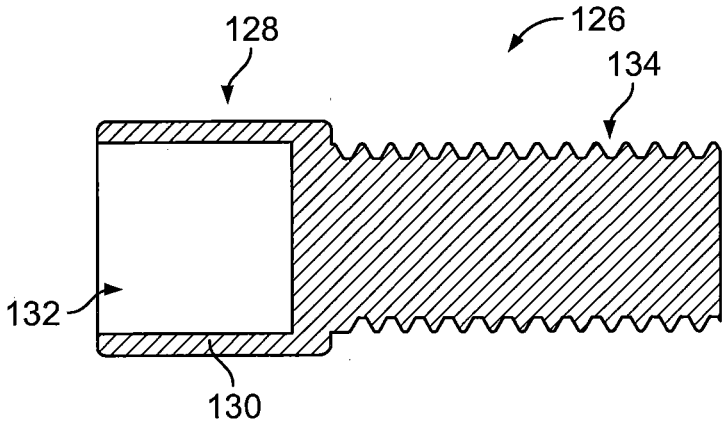
FIG. 4B is a sectional view taken along the line 4B-4B of FIG. 4A.

Referring to FIGS. 4A and 4B, the crimp fitting 126 includes a body 128 having an outer wall 130 and defining a bore or channel 132. Referring to FIGS. 3 and 4B, the first and second end portions 122, 124 of the rod may each be received in the bore 132 of one of the crimp fittings 126. The outer wall 130 may be crimped to secure the fitting 126 on the rod.

A retention feature may be used on each of the crimp fittings 126 to hold the rods 120A, 120B, and 120C in place and to help apply adequate compression to the stack 104 of varistor elements.

Figure 6:
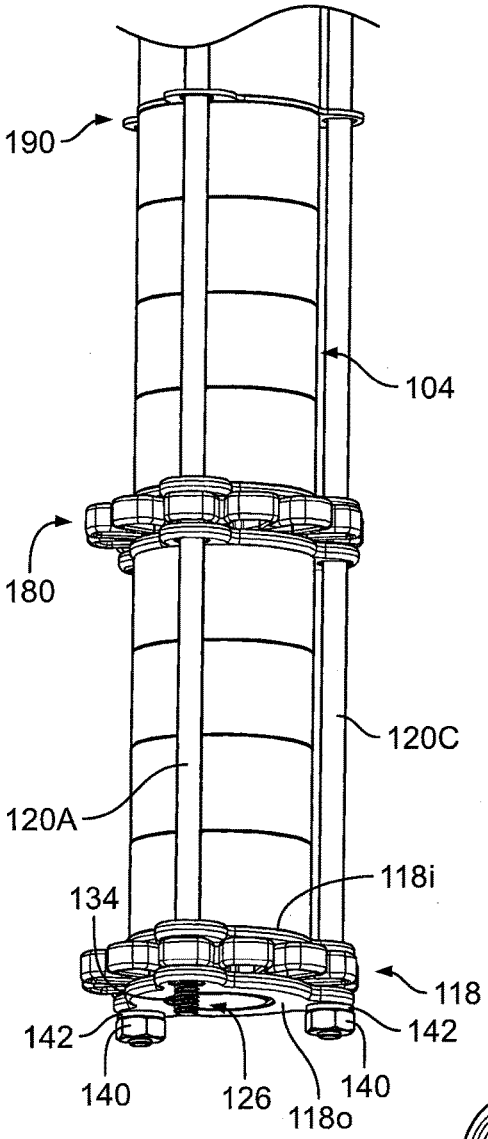
FIG. 6 is another fragmentary perspective view of the internal core assembly of FIG. 2.

For example, referring to FIGS. 4-6, the crimp fitting 126 may include a threaded portion or shaft 134 extending away from the body 128. The threaded portions 134 extend beyond the first end core support assembly 116 (FIG. 5) and beyond the second end core support assembly 118 (FIG. 6) so that the retention features may be received thereon. In other words, the threaded portions 134 may protrude from the outer surface 116*o* of the first end core support assembly and from the outer surface 118*o* of the second end core support assembly so that the retention features may be received thereon. The retention feature may include a nut 140. The retention feature may also include a washer 142 such as a split washer or a Belleville washer.

The retention features (e.g., nuts and/or washers) may be tightened and engage the first end core fitting assembly 116 (FIG. 5). Additionally or alternatively, the retention features (e.g., nuts and/or washers) may be tightened and engage the second end core fitting assembly 118 (FIG. 6).

Figure 7:
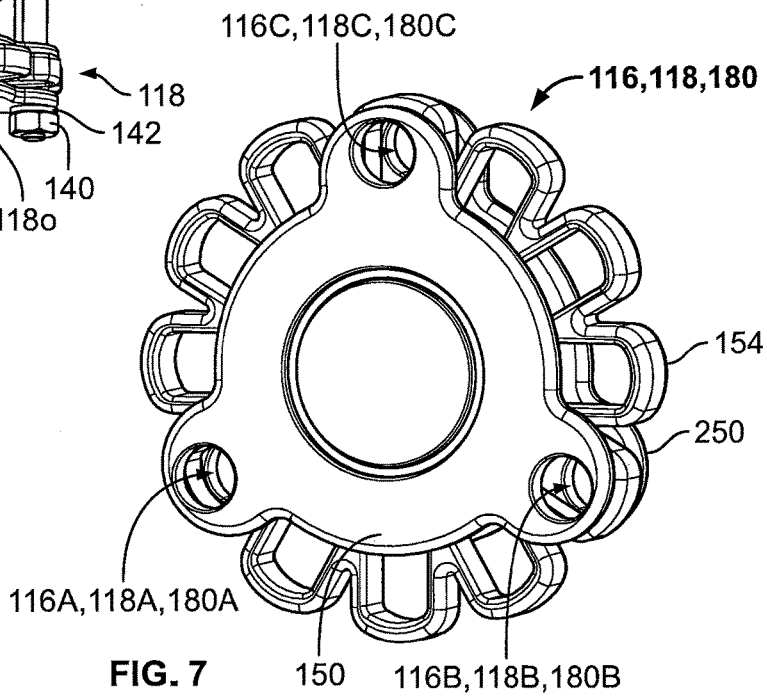
FIG. 7 is a perspective view of an end core support assembly and/or an intermediate core support assembly used with the internal core assembly of FIG. 2.

Referring to FIG. 7, the first and second end core support assemblies 116, 118 may be identical or substantially identical. A plurality of circumferentially spaced apart passageways 116A, 116B, and 116C are defined in the first end core support assembly 116. The passageways 116A, 116B, and 116C are configured to receive the first end portions 122 of the rods 120A, 120B, and 120C, respectively and/or the crimp fittings 126 installed thereon (FIG. 3). Similarly, a plurality of circumferentially spaced apart passageways 118A, 118B, and 118C are defined in the second end core support assembly 118. The passageways 118A, 118B, and 118C are configured to receive the second end portions 124 of the rods 120A, 120B, and 120C, respectively and/or the crimp fittings 126 installed thereon (FIG. 3).

Each of the first and second end core support assemblies 116, 118 may include a first core fitting 150 and a second core fitting 250 with a core support 154 between the first and second core fittings 150, 250.

Figure 8A:
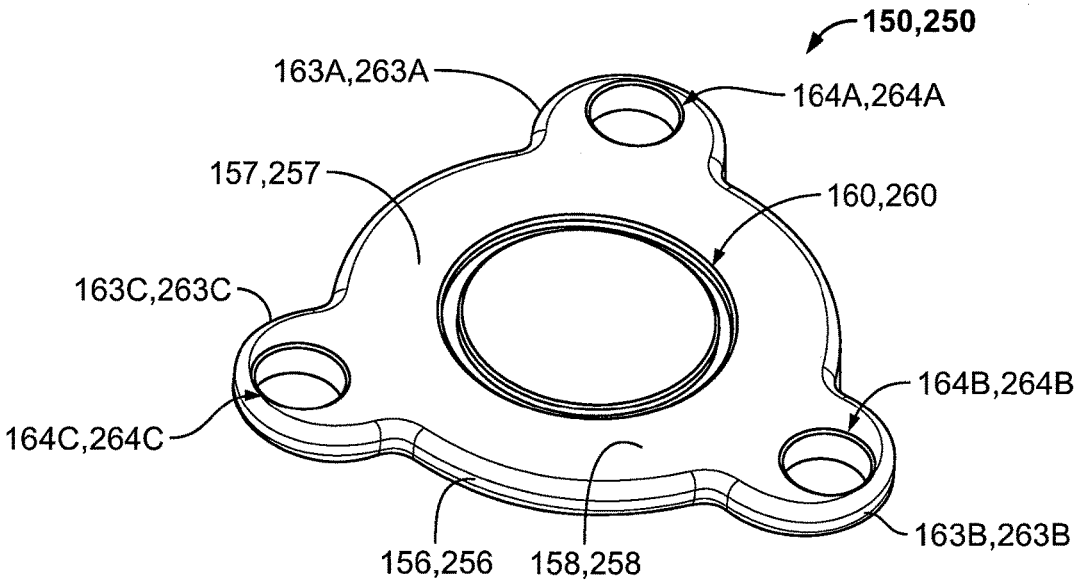
FIGS. 8A and 8B are perspective views of a core fitting used with the end core support assembly and/or the intermediate core support assembly of FIG. 7 according to some embodiments.
Figure 8B:
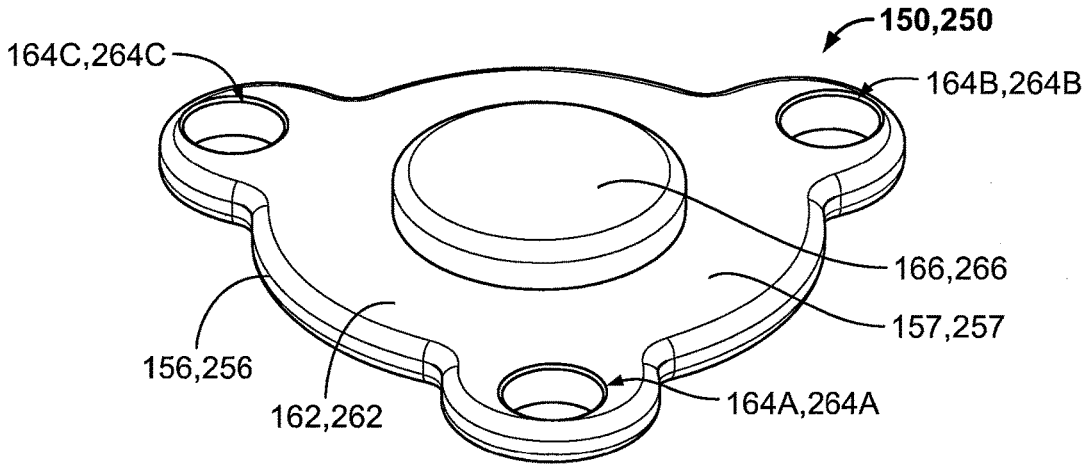

Referring to FIGS. 8A and 8B, the first core fitting 150 includes a body 156 having first and second opposite faces, sides, or surfaces 158, 162. The body 156 may include a central body portion 157 (which may be circular or round) and a plurality of tabs 163A, 163B, 163C extending outwardly from the central body portion 157. Apertures 164A, 164B, and 164C may be defined in the tabs 163A, 163B, and 163C, respectively. A circular groove 160 may be defined in the first side 158 of the first core fitting 150.

A raised portion 166 may be on the second face 162 of the first core fitting 150. Specifically, the raised portion 166 may be on the central body portion 157. The raised portion 166 may be circular and/or cylindrical.

The first and second core fittings 150, 250 may be identical or substantially identical. Referring to FIGS. 8A and 8B, the second core fitting 250 includes a body 256 having first and second opposite faces, sides, or surfaces 258, 262. The body 256 may include a central body portion 257 (which may be circular or round) and a plurality of tabs 263A, 263B, 263C extending outwardly from the central body portion 257. Apertures 264A, 264B, and 264C may be defined in the tabs 263A, 263B, and 263C, respectively. A circular groove 260 may be defined in the first side 258 of the second core fitting 250.

A raised portion 266 may be on the second face 262 of the second core fitting 250. Specifically, the raised portion 266 may be on the central body portion 257. The raised portion 266 may be circular and/or cylindrical.

Figure 9:
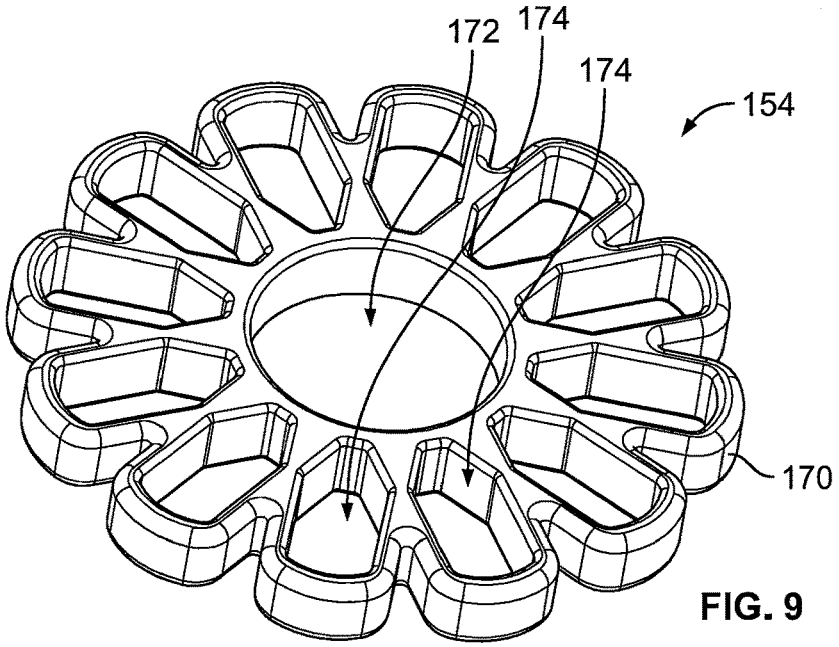
FIG. 9 is a perspective view of a core support used with the end core support assembly and/or the intermediate core support assembly of FIG. 7 according to some embodiments.

The core support 154 is illustrated in FIG. 9. The core support 154 includes a body 170. A central opening 172 is defined in the body. The central opening 172 may be circular or round. Also defined in the body 170 is a plurality of outer or peripheral openings 174. The peripheral openings 174 may surround the central opening 172.

Referring to FIGS. 7-9, the passageway 116A of the first end core support assembly 116 may be defined by the aperture 164A of the first core fitting 150, one of the outer openings 174 of the core support 154, and the aperture 264A of the second core fitting 250. The passageway 116B of the first end core support assembly 116 may be defined by the aperture 164B of the first core fitting 150, another one of the outer openings 174 of the core support 154, and the aperture 264B of the second core fitting 250. The passageway 116C of the first end core support assembly 116 may be defined by the aperture 164C of the first core fitting 150, another one of the outer openings 174 of the core support 154, and the aperture 264C of the second core fitting 152.

The passageway 118A of the second end core support assembly 118 may be defined by the aperture 164A of the first core fitting 150, one of the outer openings 174 of the core support 154, and the aperture 264A of the second core fitting 250. The passageway 118B of the second end core support assembly 118 may be defined by the aperture 164B of the first core fitting 150, another one of the outer openings 174 of the core support 154, and the aperture 264B of the second core fitting 250. The passageway 118C of the second end core support assembly 118 may be defined by the aperture 164C of the first core fitting 150, another one of the outer openings 174 of the core support 154, and the aperture 264C of the second core fitting 250.

Figure 10:
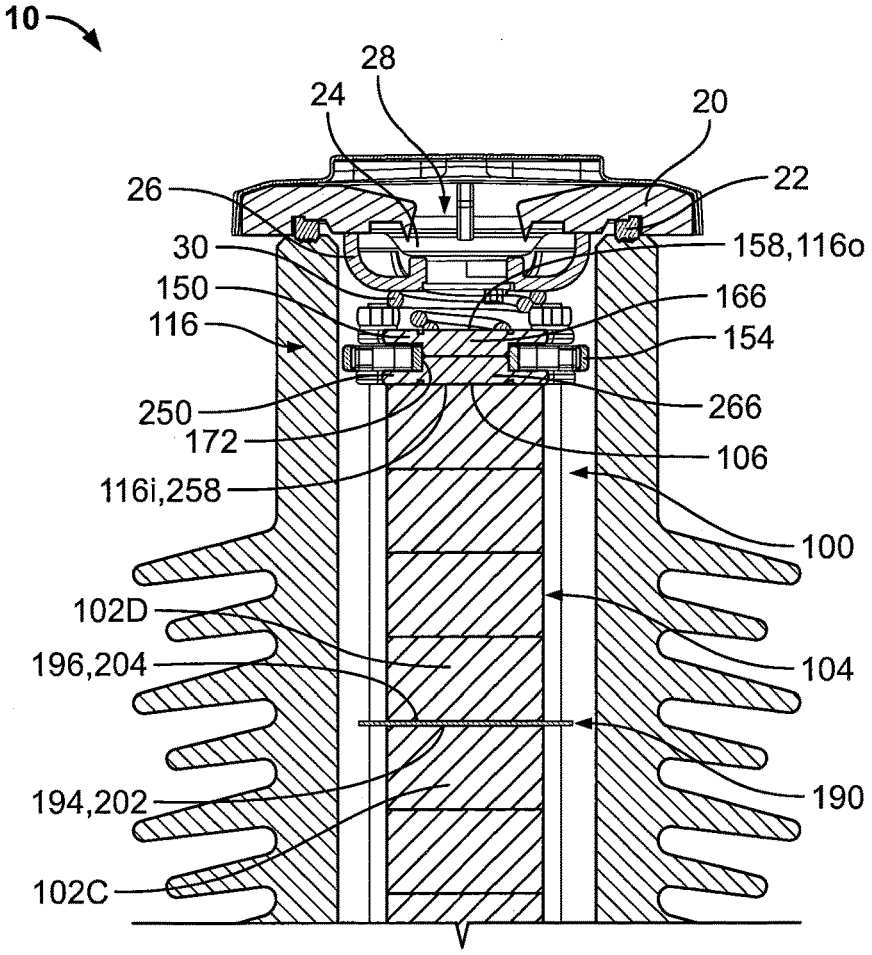
FIG. 10 is a fragmentary sectional view of the surge arrester of FIG. 1.

Referring to FIG. 10, for the first end core support assembly 116, the raised portion 166 of the first core fitting 150 and the raised portion 266 of the second core fitting 250 may be received in the central opening 172 of the core support 154. The raised portion 166 of the first core fitting 150 may contact and/or engage the raised portion 266 of the second core fitting 250 (e.g., when the internal core assembly 100 is assembled). The first surface 258 of the second core fitting 250 may contact and/or engage the first or upper surface 106 of the stack 104.

The first surface 158 of the first core fitting 150 may also be referred to herein as a first surface 158 of the first end core support assembly 116 and the first surface 258 of the second core fitting 250 may also be referred to herein as a second, opposite surface 258 of the first end core support assembly 116.

Figure 11:
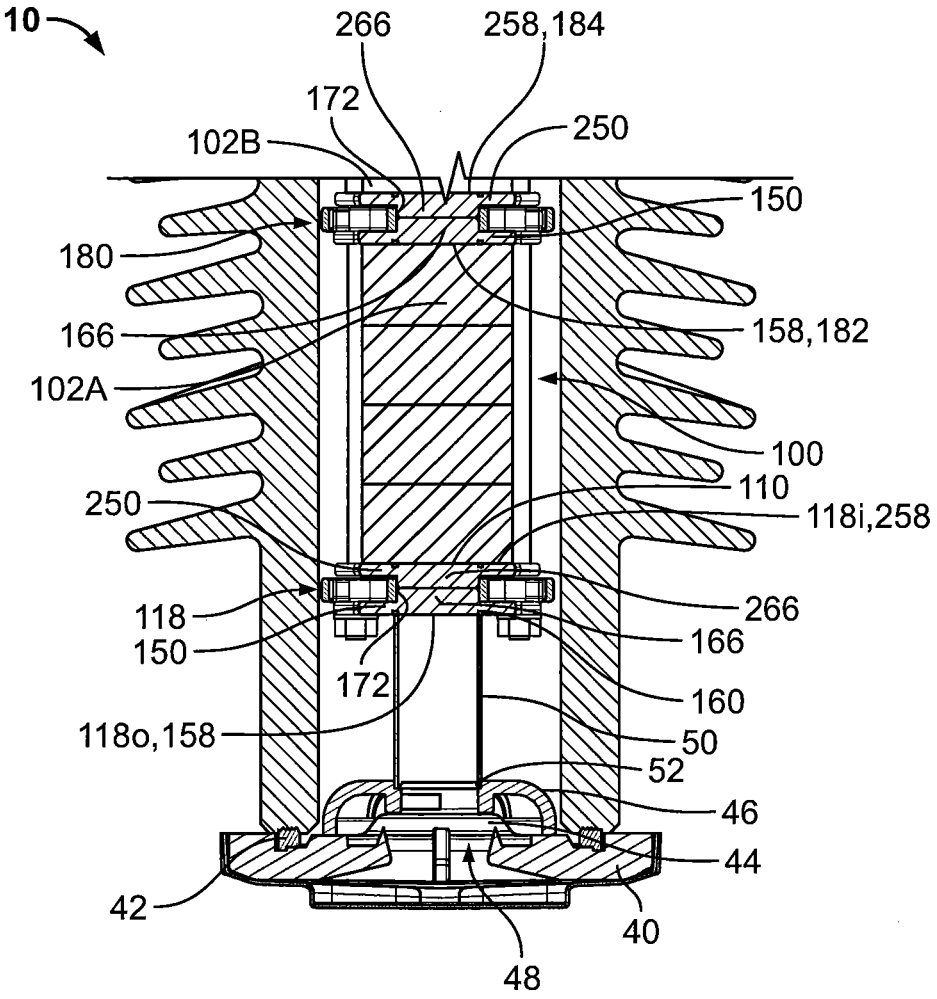
FIG. 11 is another fragmentary sectional view of the surge arrester of FIG. 1.

Referring to FIG. 11, for the second end core support assembly 118, the raised portion 166 of the first core fitting 150 and the raised portion 266 of the second core fitting 250 may be received in the central opening 172 of the core support 154. The raised portion 166 of the first core fitting 150 may contact and/or engage the raised portion 266 of the second core fitting 250 (e.g., when the internal core assembly 100 is assembled). The first surface 258 of the second core fitting 250 may contact and/or engage the second or lower surface 110 of the stack 104.

The first surface 158 of the first core fitting 150 may also be referred to herein as a first surface 158 of the second end core support assembly 118 and the first surface 258 of the second core fitting 250 may also be referred to herein as a second, opposite surface 258 of the second end core support assembly 118.

The first core fitting 150 and the second core fitting 250 may be metal such as aluminum. The core support 154 may be plastic.

Referring to FIGS. 2, 6, and 7, there may be one or more central or intermediate core support assemblies 180. Each intermediate core assembly may include passageways 180A, 180B, and 180C that receive the rods 120A, 120B, and 120C, respectively. The one or more intermediate core support assemblies 180 are positioned between the first and second end core support assemblies 116, 118. The one or more intermediate core support assemblies 180 may provide additional stability and/or support to the internal core assembly 100 and/or the rods 120A, 120B, 120C.

Each intermediate core support assembly 180 may include the first core fitting 150, the second core fitting 250, and the core support 154, which may cooperate in the same or similar way as described above in reference to the first and second end core support assemblies 116, 118. The intermediate core support assembly 180 may be positioned between adjacent ones of the varistor elements 102. For example, with reference to FIG. 11, the intermediate core support assembly 180 is positioned between varistor elements 102A and 102B. The first surface 158 of the first core fitting 150 may contact and/or engage an end surface 182 of the varistor element 102A and the first surface 258 of the second core fitting 250 may contact and/or engage an end surface 184 of the varistor element 102B (e.g., when the internal core assembly 100 is assembled).

The first surface 158 of the first core fitting 150 may also be referred to herein as a first surface 158 of the intermediate core support assembly 180 and the first surface 258 of the second core fitting 250 may also be referred to herein as a second, opposite surface 258 of the intermediate core support assembly 180.

Figure 12:
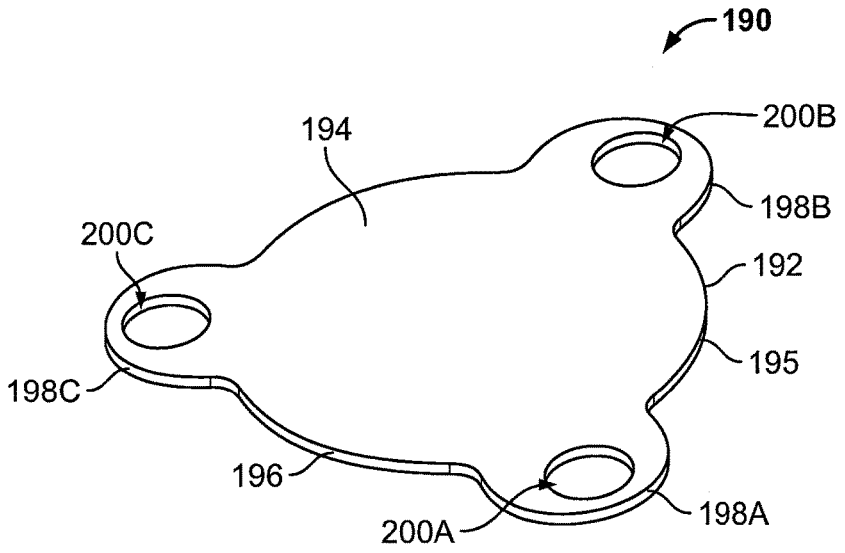
FIG. 12 is a perspective view of an interceptor plate used with the internal core assembly of FIG. 2.

Referring to FIGS. 2, 6, and 12, the assembly 100 may include a plurality of interceptor plates 190. Each interceptor plate 190 includes a body 192 having first and second opposite faces, sides, or surfaces 194, 196. The body includes a central body portion 195 (which may be circular or round) and a plurality of tabs 198A, 198B, 198C that extend outwardly from the central body portion 195. Apertures 200A, 200B, and 200C are defined in the tabs 198A, 198B, and 198C, respectively. The apertures 200A, 200B, and 200C are configured to receive the rods 120A, 120B, and 120C, respectively.

Each interceptor plate 190 may be positioned between adjacent ones of the varistor elements 102. For example, with reference to FIG. 10, the interceptor plate 190 may be positioned between adjacent varistor elements 102C and 102D. The first surface 194 of the interceptor plate 190 may contact and/or engage an end surface 202 of the varistor element 102C and the second surface 196 of the interceptor plate 190 may contact and/or engage an end surface 204 of the varistor element 102D (e.g., when the internal core assembly 100 is assembled).

The interceptor plates 190 may be metal such as aluminum. The interceptor plates 190 may provide additional stability and/or support to the internal core assembly 100 and/or the rods 120A, 120B, 120C.

Figure 13:
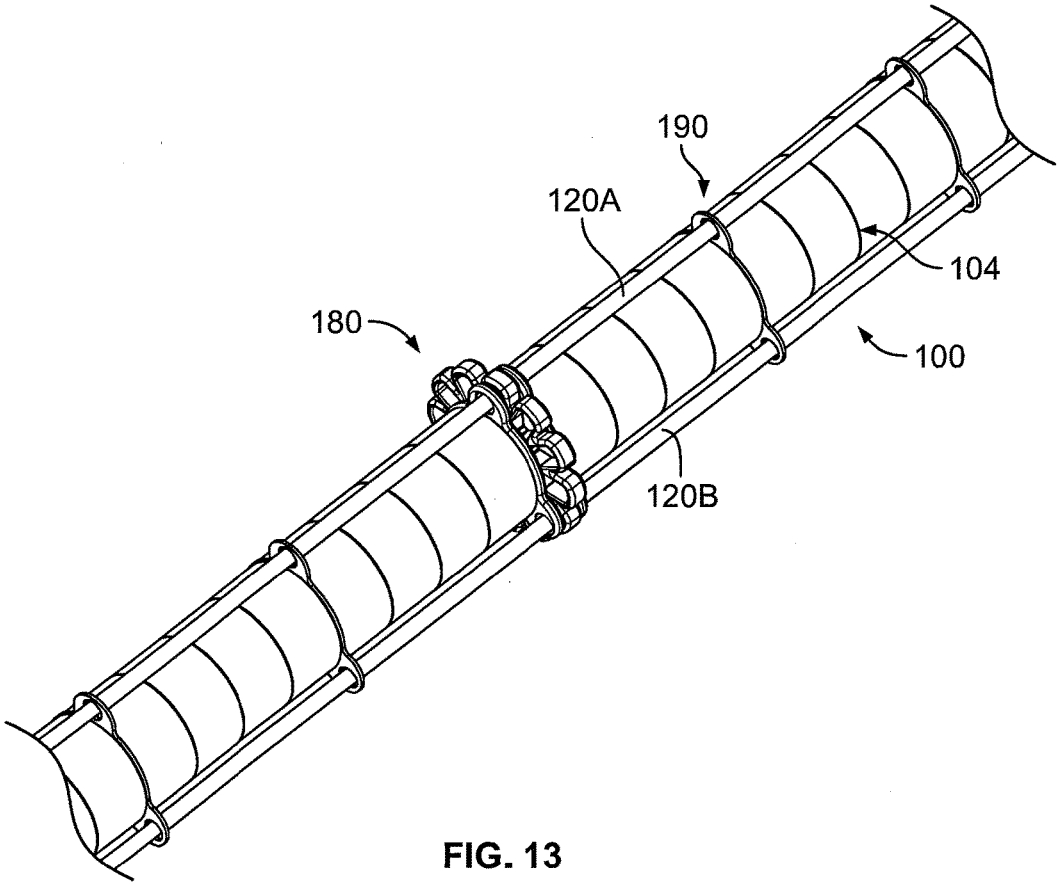
FIG. 13 is a fragmentary perspective view of the internal core assembly of FIG. 2.

Referring to FIGS. 2, 6, and 13, the first end core support assembly 116, the second end core support assembly 118, the one or more intermediate core support assemblies 180, and/or the interceptor plates 190 may space the rods 120A, 120B, 120C apart from the stack 104 of the varistor elements 102.

A method for assembling the internal core assembly 100 will now be described. The fittings 126 may be crimped on each end of the rods 120A, 120B, 120C. One of the first and second end core support assemblies 116, 118 may be received around one end of the rods 120A, 120B, 120C and nuts may be torqued on the threaded portions of the fittings 126. The stack 104 of varistor elements may be received between the rods 120A, 120B, 120C. Optionally, one or more of the intermediate core support assemblies 180 and/or one or more of the interceptor plates 190 may be installed while the stack 104 is received between the rods 120A, 120B, 120C. Once the stack 104 is in place, the other one of the first and second end core support assemblies 116, 118 may be received around the other end of the rods 120A, 120B, 120C and nuts may be torqued on the threaded portions of the fittings 126. The nuts on the fittings 126 may be further adjusted to reach the desired torque and compression for the stack 104. Washers may optionally be used between the nuts and the first and second end core support assemblies 116, 118.

Referring again to FIG. 1, the surge arrester 10 may include a housing 12. The housing 12 includes a first or upper end portion 14 and an opposite second or lower end portion 16. The internal core assembly 100 may be positioned in the housing 12 such that the stack 104 and/or the rods 120A, 120B, 120C are spaced apart from an inner wall 18 of the housing 12. In some embodiments, the entire internal core assembly 100 is spaced apart from the inner wall 18 of the housing 12. In some embodiments, the housing 12 is formed of porcelain.

Referring to FIG. 10, the surge arrester 10 may include a first or upper end plate 20 coupled to the upper portion 14 of the housing 12. A seal 22 (e.g., an annular seal) may be between the upper end plate 20 and the housing 12. A pressure relief system 28 may include a diaphragm 24 and a diaphragm support member 26. The diaphragm support member 26 may contact and/or engage the upper end plate 20. A compression member 30 such as a spring may be between the diaphragm support member 26 and the first end core support assembly 116. For example, the spring 30 may contact and/or engage the diaphragm support member 26 and/or the first surface 158 of the first end core support assembly 116.

Referring to FIG. 11, the surge arrester 10 may include a second or lower end plate 40 coupled to the lower portion 16 of the housing 12. A seal 42 (e.g., an annular seal) may be between the lower end plate 40 and the housing 12. A pressure relief system 48 may include a diaphragm 44 and a diaphragm support member 46. The diaphragm support member 46 may contact and/or engage the lower end plate 40. A spacer 50 such as a tube may be between the diaphragm support member 26 and the second end core support assembly 118. For example, a first end of the tube 50 may be received in the groove 160 in the first surface 158 of the second end core support assembly 118 and/or a second end of the tube 50 may be received in or on a recess or ledge 52 of the diaphragm support member 46. The spacer 50 may be metal such as aluminum. In some embodiments, the spacer 50 may be replaced with a compression member such as the spring 30 described above.

Figure 14:
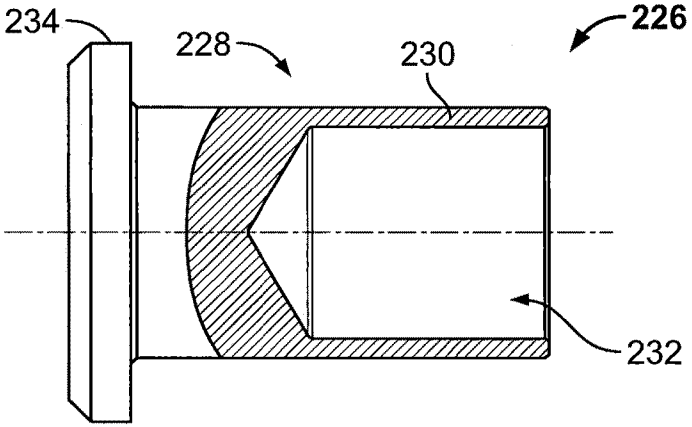
FIG. 14 is a partial sectional view of an alternative crimp fitting according to some embodiments.
Figure 15:
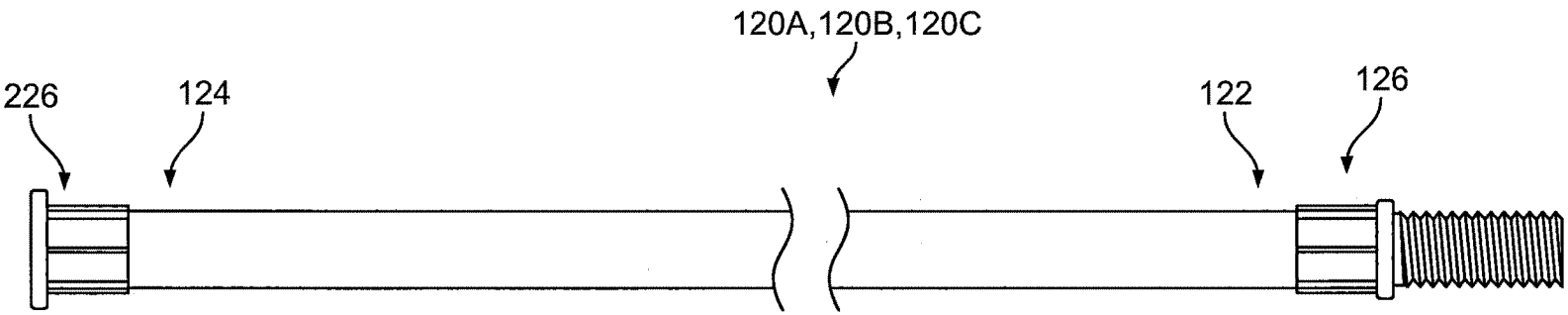
FIG. 15 is a side view of a rod having the crimp fitting of FIG. 14 installed thereon.

Referring to FIGS. 14 and 15, in some embodiments, a capped crimp fitting 226 may be installed on one end of each of the rods 120A, 120B, 120C. Unlike the crimp fitting 126 described above, the crimp fitting 226 does not include a threaded portion. The fitting 226 includes a body 228 including an outer wall 230 and defining a bore or channel 232. A head 234 may extend radially outwardly away from the body 228 and the head 234 may have a diameter that is greater than a diameter of the body 228. Similar to the fitting 126 described above, the end of the rod is received in the bore 232 and the outer wall 230 is crimped to secure the fitting 226 to the rod. Referring to FIG. 15, where the fitting 226 is used on one end of the rod, the fitting 126 is used on the other end of the rod to, for example, provide the threaded portion for receiving a retention feature such as a nut. When the internal core assembly 100 is assembled, the head 234 of each fitting 226 may engage the outer surface 118*o* of the second end core support assembly 118 (FIG. 6). For example, the head 234 of each fitting 226 may have a diameter that is greater than a diameter of each of the passageways 118A, 118B, 118C of the second end core support assembly 118 (FIG. 7), a diameter of each of the apertures 164A, 164B, 164C of the first core fitting 150 (FIGS. 8A and 8B), and/or a diameter of each of the apertures 264A, 264B, 264C of the second core fitting 250 (FIGS. 8A and 8B).

The arrester internal core assembly should be held under sufficient compression to avoid damage to the MOV blocks during the assembly process, transportation, and handling in the field, as well as to maintain electrical integrity of the part.

Known attachment arrangements for the rods such as holding the rods together with metal clips may not provide sufficient compressive strength to adequately hold the MOV blocks together. Furthermore, the assembly process can be cumbersome.

The present invention provides a method for achieving sufficient compressive strength by crimping threaded end fittings to the fiberglass (FRP) rods. The required compression is achieved by applying the appropriate torque to fasteners (e.g., nuts) on the threaded end fittings and/or by use of split or Belleville washers. A cage is formed with a number of crimped FRP rods and the MOV blocks are supported within the cage.

The threaded end fitting allows for adjustment to attain various levels of compression. The threaded end fitting also allows for flexibility depending on the length or height of the stack of MOV blocks.

The arrangements described herein also make it easier to assemble the internal core assembly, handle the internal core assembly, and install the internal core assembly to the arrester housing. In addition, enhanced seismic performance of the arresters may be realized.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

What is claimed is:

1. A surge arrester comprising:

an internal core assembly comprising:

a plurality of varistor elements electrically connected in series and forming a stack of the plurality of varistor elements, wherein the stack has a first end surface, a second end surface, and a side surface extending between the first end surface and the second end surface;

a first end core support assembly at the first end surface of the stack, the first end core fitting assembly comprising an inner surface that faces the stack and an opposite outer surface, the first end core support assembly comprising a plurality of circumferentially spaced apart passageways that extend from the inner surface to the outer surface;

a second end core support assembly at the second end surface of the stack, the second end core fitting assembly comprising an inner surface that faces the stack and an opposite outer surface, the second end core support assembly comprising a plurality of circumferentially spaced apart passageways that extend from the inner surface to the outer surface;

a plurality of rods disposed around the side surface of the stack, each rod comprising a first end that is received in a corresponding one of the plurality of passageways of the first end core support assembly and a second end that is received in a corresponding one of the plurality of passageways of the second end core support assembly;

a first crimp fitting at the first end of each of the plurality of rods, each first crimp fitting comprising a body comprising an outer wall defining a bore with the first end of the rod received in the bore and with the outer wall crimped to secure the first crimp fitting on the first end of the rod; and a retention feature on each of the first crimp fittings with each retention feature engaging the first end core support assembly to apply compression to the stack.

2. The surge arrester of claim 1 wherein:

each first crimp fitting comprises a threaded portion extending away from the body of the first crimp fitting and protruding from the outer surface of the first end core support assembly; and the retention feature on each of the first crimp fittings comprises a nut that is configured to be threadingly received on the threaded portion of the first crimp fitting.

3. The surge arrester of claim 2 wherein the retention feature on each of the first crimp fittings comprises a washer between the first end core support assembly and the nut.

4. The surge arrester of claim 2 wherein the first end core support assembly comprises first and second core fittings and a core support between the first and second core fittings.

5. The surge arrester of claim 4 wherein:

the first and second core fittings each include a body comprising a first side and a second opposite side;

the first side of the body of each of the first and second core fittings includes a raised portion at a central portion thereof;

the core support comprises a body with a central opening defined therein; and the first side of the first core fitting faces the first side of the second core fitting and the raised portions of each of the first and second core fittings are received in the central opening of the core support.

6. The surge arrester of claim 5 wherein the first and second core fittings are metal and the core support is plastic.

7. The surge arrester of claim 2 wherein:

the stack defines a longitudinal axis; and the plurality of passageways of the first end core support assembly are parallel to the longitudinal axis.

8. The surge arrester of claim 2 wherein:

a second crimp fitting is at the second end of each of the rods, each of the second crimp fittings comprising a body comprising an outer wall defining a bore with the second end of the rod received in the bore and with the outer wall crimped to secure the second crimp fitting on the second end of the rod;

each second crimp fitting comprises a threaded portion extending away from the body of the second crimp fitting and protruding from the outer surface of the second end core support assembly; and a retention feature is on each of the second crimp fittings and comprises a nut that is configured to be threadingly received on the threaded portion of the second crimp fitting.

9. The surge arrester of claim 2 wherein the internal core assembly further comprises one or more intermediate core support assemblies positioned between the first and second end core support assemblies, each intermediate core support assembly comprising a plurality of circumferentially spaced apart passageways with one of the plurality of rods received in a corresponding one of the passageways.

10. The surge arrester of claim 9 wherein:

each intermediate core support assembly comprises first and second core fittings and a core support between the first and second end core fittings; and each intermediate core support assembly is positioned between adjacent ones of the plurality of varistor elements in the stack with the first core fitting engaging one of the adjacent varistor elements and the second core fitting engaging the other one of the adjacent varistor elements.

11. The surge arrester of claim 2 wherein the internal core assembly further comprises a plurality of interceptor plates between the first and second end core support assemblies, each interceptor plate comprising a plurality of circumferentially spaced apart apertures, wherein each rod is received in a corresponding one of the plurality of apertures of the interceptor plate.

12. The surge arrestor of claim 11 wherein:

each interceptor plate includes a body comprising first and second opposite sides, the body comprising a central body portion and a plurality of tabs extending outwardly from the central body portion and with one of the plurality of apertures defined in each tab;

each interceptor plate is positioned between adjacent ones of the plurality of varistor elements in the stack with the first side of the interceptor plate body engaging one of the adjacent varistor elements and the second side of the interceptor plate body engaging the other one of the adjacent varistor elements.

13. The surge arrestor of claim 12 wherein each interceptor plate is metal.

14. The surge arrester of claim 1 wherein each of the rods is spaced apart from the stack.

15. The surge arrestor of claim 1 further comprising an elongated housing, wherein the internal core assembly is positioned in the housing.

16. The surge arrestor of claim 15 wherein the internal core assembly is spaced apart from an inner surface of the housing.

17. An internal core assembly for a surge arrestor, the internal core assembly comprising:

a stack of metal-oxide varistor elements, the stack comprising a first end surface, a second end surface, and a side surface;

first, second, and third elongate rods disposed around the outer surface of the stack, each of the first second, and third rods comprising a first end and an opposite second end;

a first crimp fitting secured on the first end of each rod, each first crimp fitting comprising a body crimped on the first end of the rod and a threaded shaft extending from the body;

a second crimp fitting secured on the second end of each rod, each second crimp fitting comprising a body crimped on the second end of the rod and a threaded shaft extending from the body;

a first end core support assembly at the first end surface of the stack, the first end core support assembly comprising an inner surface that faces the stack and an opposite outer surface, the first end core support assembly comprising first, second, and third circumferentially spaced apart passageways receiving the first ends of the first, second, and third rods, respectively, wherein the threaded shaft of each first crimp fitting protrudes from the outer surface of the first end core support assembly;

a second end core support assembly at the second end surface of the stack, the second end core support assembly comprising an inner surface that faces the stack and an opposite outer surface, the second end core support assembly comprising first, second, and third circumferentially spaced apart passageways receiving the second ends of the first, second, and third rods, respectively, wherein the threaded shaft of each second crimp fitting protrudes from the outer surface of the second end core support assembly;

a plurality of first retention features, each threadingly engaged with the threaded shaft of one of the first crimp fittings and engaging the outer surface of the first end core support assembly; and a plurality of second retention features, each threadingly engaged with the threaded shaft of one of the second crimp fittings and engaging the outer surface of the second end core support assembly.

18. A method of assembling a surge arrester, the method comprising:

crimping a first crimp fitting on a first end of each of first, second, and third elongated rods, each crimp fitting comprising a body that is crimped on the first end of the rod and a threaded shaft that extends away from the body;

forming at least a portion of a cage by coupling a second, opposite end of each of the first, second, and third rods to a second end core support assembly;

receiving a stack of a plurality of varistor elements between the first, second, and third rods such that a first end surface of the stack is at the second end core support assembly;

receiving the first ends of the first, second, and third rods in first, second, and, third passageways, respectively, of a first end core support assembly such that an inner surface of the first end core support assembly faces the stack and the threaded shaft of each first crimp fitting protrudes from an opposite outer surface of the first end core support assembly; and installing a retention feature on the threaded shaft of each of the first crimp fittings such that the retention feature engages the first end core support assembly, wherein each retention feature comprises a nut that threadingly engages the threaded shaft of the first crimp fitting.

19. The method of claim 18 wherein:

the method further comprises crimping a second crimp fitting on the second end of each of the first, second, and third elongated rods, each second crimp fitting comprising a body that is crimped on the second end of the rod and a threaded shaft that extends away from the body; and forming at least a portion of a cage by coupling a second, opposite end of each of the first, second, and third rods to a second end core support assembly comprises:

receiving the second ends of the first, second, and third rods in first, second, and, third passageways, respectively, of the second end core support assembly such that an inner surface of the second end core support assembly faces the stack and the threaded shaft of each second crimp fitting protrudes from an opposite outer surface of the second end core support assembly; and installing a retention feature on the threaded shaft of each of the second crimp fittings such that the retention feature engages the second end core support assembly, wherein each retention feature comprises a nut that threadingly engages the threaded shaft of the second crimp fitting.

* * * * *